United States Patent [19]

Thomas

[11] Patent Number: 4,493,353

[45] Date of Patent: Jan. 15, 1985

[54] NAIL GUIDE AND SET

[76] Inventor: John Thomas, 2984 Canna St., Thousand Oaks, Calif. 91360

[21] Appl. No.: 580,564

[22] Filed: Feb. 15, 1984

[51] Int. Cl.[3] ..... B25C 3/00

[52] U.S. Cl. ..... 145/46; 145/30 R

[58] Field of Search ..... 145/46, 30 R, 30 A

[56] References Cited

U.S. PATENT DOCUMENTS 2,783,799 3/1957 Hart ..... 145/46

4,422,489 12/1983 Ross ..... 145/46

*Primary Examiner*—Frederick R. Schmidt

*Assistant Examiner*—J. T. Zatarga

*Attorney, Agent, or Firm*—Richard S. Koppel; Michael D. Harris

[57] ABSTRACT

A tool for countersinking nails into a workpiece has a base member, which is formed of resilient material, and has a generally flat bottom section resting on the workpiece. A metal guide is mounted in the base member. The guide has a central opening for receiving a nail in its bottom. A rigid cap member on the base above the guide has an aperture through it, and a nail set extends partially upward out of the aperture in the cap and extends into the opening in the guide above the nail for transmitting impact from a hammer on the nail. The bottom of the guide member is recessed from the bottom surface of the base so that the metal will not contact the workpiece. The cap has a greater diameter than the guide so that if the cap is struck when the bottom or the nail set is below the top of the workpiece, an impact on the cap is not transmitted to the guide but will be absorbed in the resilient material of the base. A nail starting section integral with the base member extends laterally outward. It contains starting holes that grip nails initially. A slot extends from each opening to a larger opening, and the tool can be pulled over a nail until the nail is in the larger opening where it can be removed from the nail.

18 Claims, 4 Drawing Figures

NAIL GUIDE AND SET

BACKGROUND OF THE INVENTION

1. Field of the Invention

This invention relates to a tool for starting a nail and for guiding a nail set for setting finishing nails to prevent damage to the workpiece from hammer marks and incorrectly placed nail sets.

2. Description of the Prior Art

Nailing, a common carpentry procedure, is usually accomplished by starting a nail initially holding the nail between the thumb and forefinger of one hand and striking the nail with a hammer held in the other hand. This procedure works well with large, common nails, but it requires more skill with smaller, finishing nails. Some are too short to start; they may not extend beyond the top of the thumb. If misstruck, they can easily bend or being to enter the wood at an angle which can damage the surface of the workpiece.

Devices have been constructed in the past to assist one in starting a nail. Examples of such tools include Sudol, U.S. Pat. No. 3,946,779 (1976) in which a piece of resilent material with a radial slot grips a nail during the initial driving and Biblis, U.S. Pat. No. 2,716,750 (1955) in which nail receiving openings are formed at the intersection of movable jaws. The disadvantages of these tools are that an open slot increases the possibility that a nail can move out of the slot if it is hit incorrectly, and opening and closing jaws complicate a tool.

Once a nail initially engages the workpiece, the nail is driven without anything other than the workpiece holding the nail. If one misses the nail, the resulting damage to the workpiece is very difficult to conceal. If one hits the nail at a slight angle, or off center, it may bend or be at an angle. Even if the nail can be centered again, damage in the form of a larger opening remains. Therefore, it is desirable to have a guard over the workpiece around the nail to prevent the hammer from striking the workpiece and also to assist in holding the nail. The two previously mentioned patents act as guards. See also Auchard, U.S. Pat. No. 2,878,476 (1959).

Once the nail is driven almost entirely into the wood with the top of the nail extending only a very short distance above the surface of the workpiece, it must be driven all the way into the workpiece. Typically, the top of the nail is countersunk approximately $\frac{1}{8}$ inch (3 mm) below the surface of the workpiece with a nail set. The initial driving of the nail is stopped with the head slightly above the surface of the workpiece. Unless one stops at that location, the hammer will have struck the wood and left a mark. Once in that position, one drives the nail below the surface of the wood with a nail set. Nail sets, however, occasionally slip off of the small heads of finishing nails creating a hole in the wood next to the nail. It also takes considerable skill to set the nail at the proper depth.

There have been a number of tools developed to assist in setting a nail. Holstein, U.S. Pat. No. 4,008,741 (1977) mounts a nail set in resilient material that is positioned above the nail. The resilent material also surrounds the top of the nail. Striking the nail set with a hammer deforms the resilent material somewhat and allows the bottom of the nail set to drive the nail into the workpiece. Hart, U.S. Pat. No. 2,783,799 (1957) is of a somewhat similar structure, but it holds the nail in a diverging slot. These nail setting tools suffer from similar drawbacks. Because resilient material surrounds the nail, the nail can be offset into the resilient material if the nail strikes a knot or other hard surface in the wood. Hart is not adaptable to different sized nails. With a wider diameter one, for example, the nail will find a different location in the slot such that it will not be centered over the nail set.

It is also difficult in the prior art to determine exactly when the nail is precisely set. Where the materials supporting the nail set deforms, there is a tendency to continue hitting the tool. Where the resilient member is struck, moreover, the material surrounding the nail tends to creep outward during each blow, which tends to leave a mark on the workpiece.

SUMMARY OF THE INVENTION

The principal object of the present invention is to provide and disclose a device to set finishing nails into a workpiece quickly and easily without leaving hammer marks and to prevent against damaging the workpiece by improper use of a nail set. In keeping with this object, it is important that the present invention be formed in such a way that the force of the hammer that is transmitted to the wood be absorbed by the tool and the force from the hammer that is transmitted to the nail be directed entirely to the nail without being absorbed by the tool. It is also important that the tool securely hold the nail at the desired angle to the wood. Another object of the present invention is to disclose and provide a nail setting tool that is adjustable for different sized nails. Another object of the present invention is to disclose and provide a combined tool that holds a nail being started securely and that also guards the workpiece against incorrect hammer blows.

These objects and others which are evident in this specification, are met by this invention. The tool of the present invention comprises a base member formed of resilent material with a generally flat bottom surface for being supported on the workpiece. A guide member formed of rigid material is mounted in the base member. The guide member has a central opening for receiving a nail for movement through the bottom portion of the central opening. A rigid cup member is mounted on the base member above the guide member. The cup has an aperture though it out of which the top of the nail set extends. The bottom of the nail set extends through the opening in the guide member above the nail. The bottom of the guide member is recessed somewhat from the bottom surface of the base to prevent the rigid material of the guide member from striking or contacting the workpiece. When one strikes the top of the nail set, it transmits force to the nail. When the nail is fully countersunk, the hammer will strike the top of the rigid cap. The cap is of a wider diameter than the guide so that the force from continued blows is transmitted to the resilient base member where it will be absorbed.

A starting section extending to one side is integrally formed with the base member. The starting section has a bottom surface that is co-planar with the bottom of the base. A number of holes extend through the starting section. A nail may be inserted into one of the holes, and it is gripped by the resilient material of the starting section. The nail is held in its desired position by the resilient material until it is struck and driven into the workpiece. The nail is driven until it is near the top surface of the starting section, and the starting section acts as a guard in case the nail is missed. The nail starting openings have a normally closed slot extending from them either to a secondary opening larger than the nail to allow the starting section to be removed from the nail, or the normally closed slot can extend to the periphery of the starting section so that the starting section can be slid off of the nail. The starting openings can also be at an angle through the starting section for driving nails that are not perpendicular to the surface of the workpiece.

DETAILED DESCRIPTION OF THE PREFERRED EMBODIMENT

Figure 1:
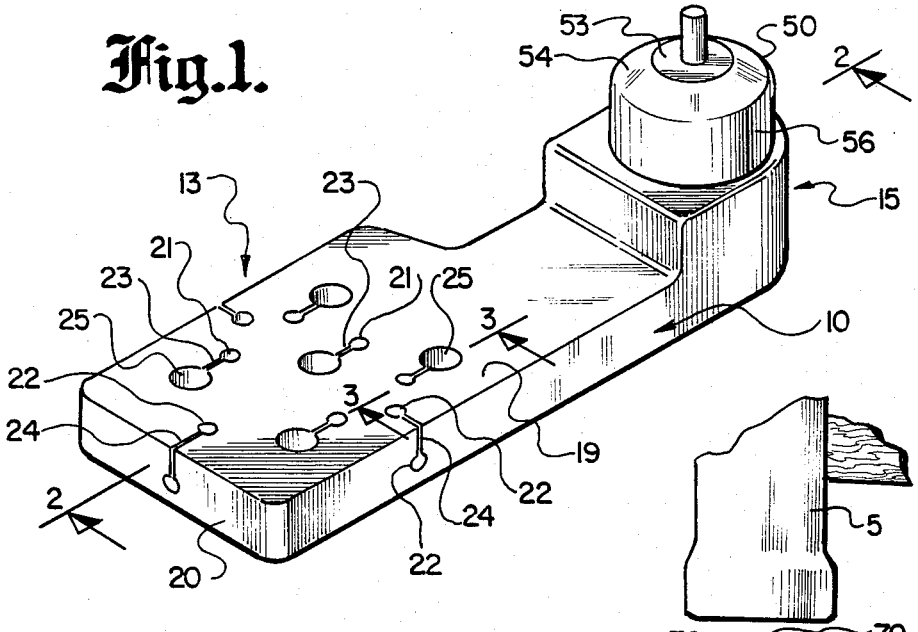
FIG. 1 is a perspective view of the tool of the present invention.

The tool of the present invention has a base member formed of resilient material having a generally flat bottom surface for being supported on the workpiece into which a nail is to be driven. Base member 10 in the exemplary embodiment is formed in one piece of elastomeric material such as rubber and has a generally flat bottom surface 11. For convenience, it is divided into two sections, a starting section 13 on the left (FIGS. 1, 2 and 3) and a setting section 15 on the right FIGS. 1, 2 and 4). The bottom surface 11, which extends across the entire bottom of starting section 13 and setting section 15, rests on the top surface of workpiece 1. The starting section 13 is somewhat wider than finishing section 15 (FIG. 1), and starting section 13 also has a tapering portion 17 (FIG. 1) where it narrows to the width of setting section 15. Tapering portion 17 is easily gripped for holding the entire tool. The top surface 19 is flat and parallel with bottom surface 11.

Figure 2:
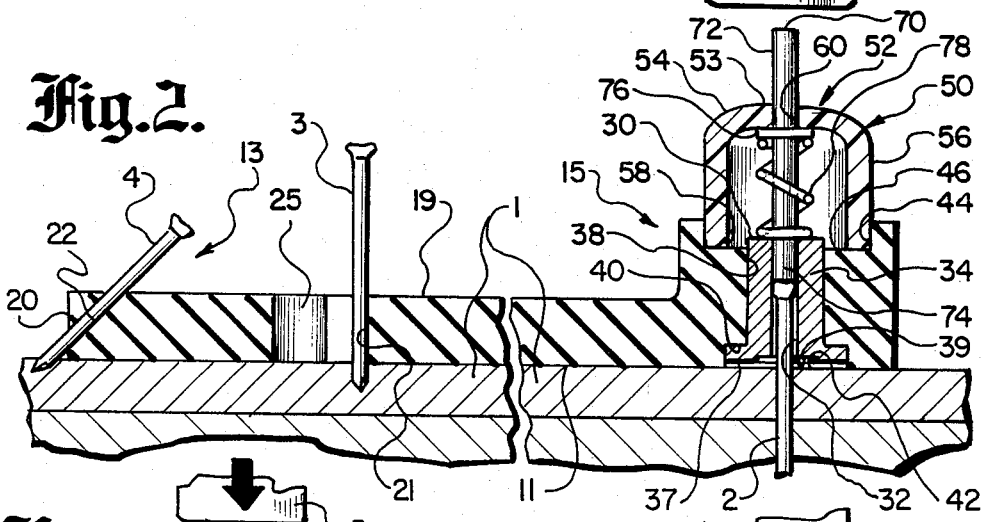
FIG. 2 is a front sectional view of the tool of the present invention taken through plane 2—2 of FIG. 1.
Figure 3:
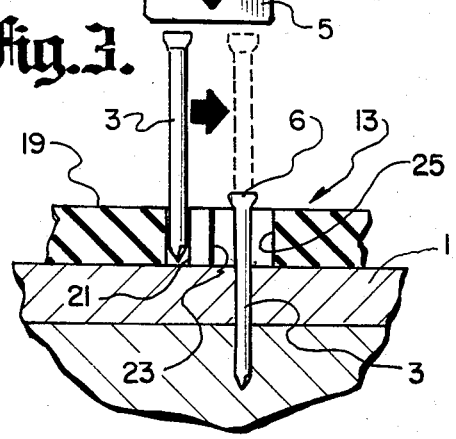
FIG. 3 is also a sectional view taken through plane 3—3 in FIG. 1 showing how a nail started in the tool of the present invention.

Starting section 13 has a plurality of nail starting openings 21 and 22 (FIGS. 1, 2 and 3). As shown primarily in FIG. 3, finishing nail 3 is inserted into one of the nail starting openings 21 in contact with workpiece 1. Because of the resilient material of base member 10, nail 3 is held in its desired vertical position. Hammer 5 then drives nail 3 until head 6 protrudes slightly above top surface 19 (FIG. 3) or is flush with top surface 19. If one misses the nail, the hammer will strike the resilient material in starting section 13, and the impact will be absorbed to protect the workpiece.

Once the nail is in the downward (right hand) position shown in FIG. 3, the tool must be removed from the nail. A finishing nail such as those shown in the drawings is normally removed by lifting the starting section over head. For nails with flat, large heads, nail removing means in starting section 13 adjacent openings 21 provide for removing the tool off the nail. The removing means of the present invention includes a slot leading from each of the nail starting openings 21. The slots 23 may be normally closed by the resilient material of base 10, but the resilient material can spread slightly as the tool is moved to the left (FIG. 3) so that nail 6 passes through resilient slot 23. Molding tolerances may make it difficult to manufacture base 10 with closed slots 23. The slots should be normally narrower than the diameter of openings 21. At the end of resilient slot 23 opposite starting openings 21 is a secondary opening 25 that is larger in diameter than head 6 of nail 3 so that the starting section 13 can be lifted off the nail.

In addition to starting openings 21, which extend perpendicular to bottom 11 of the tool and are connected by resilient slots 23 to secondary openings 25, additional starting openings 22 are provided near the periphery of starting section 13 (FIGS. 1 and 2). Openings 22 are at an angle to workpiece 1 starting at an angle through top 21 and terminating at an angle through side 20 of starting section 13 (FIGS. 1 and 2) so that nail 4 (FIG. 2) enters workpiece 1 at an angle. A slot 24 extends from each of the angled starting openings 22 to the periphery. Because of the proximity of slots 22 to the periphery, when slot 24 is pulled along the nail, the nail will be removed entirely from starting section 13.

Returning back to nail 3 in the partially driven-in position (right side in FIG. 3), the nail must be driven and set after starting section 13 is removed from the nail. Guide means 30 (FIGS. 2 and 4) formed of rigid material is mounted in base member 10 and has a central opening 32 that is shown receiving nail 2. Guide means 30 is preferably formed of steel and has a vertical body 34 and a bottom circular flange 36. Setting section 15 of base 10 has a cylindrical opening 38 (FIG. 2) with a wider diameter portion 40 extending up from the bottom 11. The height of wider diameter opening 40 is slightly greater than the height of flange 36 to create a slight recess 42 between the bottom surface 37 of flange 36 and the bottom surface 11 of base 10. In the exemplary embodiment, the top of body 34 of guide means 30 extends into an upper opening 44 above wall 46. The top of body 34 could be located within opening 38 below wall 46 in setting section 15.

Figure 4:
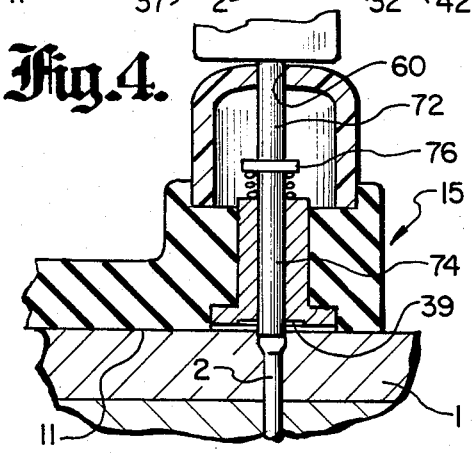
FIG. 4 is a sectional view through plane 2—2 in FIG. 1 showing the position of the tool when a nail is completely set.

A rigid cap 50, which is formed of hard plastic in the exemplary embodiment, is mounted on base member 10 above guide means 30. Cap 50 has a top 52 that in the exemplary embodiment is generally flat near its center 53 and rounded near its periphery 54. The top curves into cylindrical side wall 56 (FIGS. 1, 2 and 4). The outside diameter of cylindrical side wall 56 is approximately equal to the inside diameter of upper opening 44 of base 10, and the resilient material of the base holds cap 50 securely in opening 44 against wall 46. The diameter of cylindrical wall 56 is greater than the diameter of cylindrical body 34 of guide means 30 creating an annular space 58 between them. Cap 50 must be made sufficiently thick and of proper shape and materials to prevent it from being damaged by hammer blows.

Aperture 60 (FIGS. 2 and 4) extends through the center of upper portion 52 of cap 50. Impact transmissions means in the aperture extends into the opening of the guide means above a nail for transmitting impacts from a hammer to the nail. In the exemplary embodiment, the impact transmission means or nail set 70 is formed of cylindrical steel having an upper portion 72 and a lower portion 74 separated by cylinderical flange 76. Upper portion 72 extends through cap aperture 60, and a spring 78 extends between the top of guide member 30 and the bottom of flange 76 to urge set 70 to an upper, normal position (FIG. 2). Lower portion 74 is of a diameter slightly less than the inside diameter of opening 32 of guide member 30 so that set 70 can move freely vertically in aperture 60 and opening 32. The length of lower portion 74 of set 70 should be such that its bottom contacts or is slightly above nail 2 in the upper most position (FIG. 2) of set 70 with bottom 11 of base 10 lying flat on workpiece 1.

One then strikes the top of set 70 with hammer 5 until nail 2 is in the FIG. 4 position. Immediately before nail 2 is countersunk (FIG. 4), its head will still be within opening 32 of guide member 30 insuring that set 70 is directly over nail 2. At that time, a small length of upper portion 72 of set 70 will protrude above the top surface of upper portion 52 of cap 50. The dimensions of the tool of the present invention are such that the top of set 70 protrudes slightly from aperture 60 when the bottom of set 70 is parallel with the top surface of workpiece 1, and the top of set 70 is flush with the top of cap 50 only when nail 2 is properly set with part of the bottom of set 70 below the top surface of workpiece 1. Therefore, when the top of set 70 no longer protrudes from cap 50, the nail is properly set; until then, further hammer blows are necessary.

In the fully set position, flange 76 does not contact the top of guide member 30. Spring 78 is relatively weak, and it transmits practically no force on guide member 30. Thus, even when set 70 is in its FIG. 4 position, set 70 transmits no vertical forces on guide means 30 which ultimately could be transmitted to workpiece 1 to mar it. Continued blows by hammer 6 on set 70 in the FIG. 4 position also will not damage workpiece 1. Because of the wide diameter of side wall 56 of cap 50 creating an annular space 58 around the outside of guide member 30, any vertical forces from hammer 5 on cap 50 are transmitted to base member 10 rather than to guide member 30. Setting section 15 of base 10 is quite thick and is formed of elastomeric material. Therefore, some of the impact from hammer 5 is absorbed by the material of base member 10, and the remainder is transmitted along a large area by the relatively soft material of base 10 to workpiece 1 causing no damage to the workpiece. Recess 42 between the bottom 36 of guide member 30 prevents the hard metal guide member from contacting workpiece 1 even on very hard hammer blows to cap 50. A second recess 39 may be provided in the bottom 37 of guide member 30 for receiving the head of common nails. Although such nails will not pass through guide 30, the tool can be used for driving the nail head flush with workpiece 1.

It is best that the inside diameter of opening 32 in guide member 30 be only slightly greater than the outside diameter of the head of nail 2 so that the nail moves freely in opening 32 but cannot move side-to-side or at an angle. With different sized nails, different guide members should be used, and it is also best if a different, correctly-sized set is used. The tool of the present invention can provide for such replacement. First, cap 50 is removed from opening 44, and nail set 70 is removed from the top of opening 32 of guide member 30. The guide member can be removed by forcing it downward through opening 38 in base member 10. A tool should not be necessary because a portion of the cylindrical body 34 of guide member 30 extends slightly above wall 46 into opening 44 of base 10. Pushing on this portion dislodges flange 37 from opening 40 and allows one to grip the flange and remove guide member 30. Then, a new guide member with a different inside diameter central opening is replaced in opening 38. Preferably, a new nail set 70 would then be provided. The diameter of upper portion 72 of nail set 70 should stay constant with different nail sets because opening 60 in cap 50 does not change. Therefore, it is only necessary to change the diameter of lower portion 74 of the nail set.

One possible change entails making cap 50 unitary with and of the same material as setting section 15 of base 10. The portion that would replace cap 50 would be somewhat taller and have thicker walls than cap 50. There would be a central opening in the cap-like portion through which set 70, flange 76 and guide 34 can be inserted and removed.

Various other modifications and changes may be made in the configuration described above that come within the spirit of the invention. The invention embraces all such changes and modifications coming within the scope of the appended claims.

I claim:

1. A tool for use in driving nails into a workpiece comprising:

(a) a base member formed of resilient material having a generally flat bottom surface for being supported on the workpiece;

(b) guide means formed of rigid material in the base member having a central opening for receiving a nail for movement through the bottom portion of the central opening;

(c) a rigid cap member on the base member above the guide means having an aperture through it; and (d) impact transmission means in the aperture of the cap means and extending into the opening in the guide means above the nail for transmitting impact from a hammer to the nail.

2. The tool of claim 1 wherein the guide bottom means has a surface, the bottom surface having an indentation around the central opening.

3. The tool of claim 1 wherein the guide means has a bottom surface recessed above the bottom surface of the base member.

4. The tool of claim 3 wherein the guide means has a flange extending around the bottom of the guide means.

5. The tool of claim 1 wherein the cap member and guide means have separating means for separating the cap member and the guide means to limit forces transmitted between the cap member and guide means.

6. The tool of claim 5 wherein the cap member is cup-shaped having downwardly extending walls on the top of the base member, the aperture extending through the top of the cap.

7. The tool of claim 6 wherein the means separating comprise the provision of the walls of the cap being mounted on the base member outside of the guide means.

8. The tool of claim 1 wherein the cap member is cup-shaped having downwardly extending walls on the top of the base member, the aperture extending through the top of the cap.

9. The tool of claim 1 further comprising stop means on the impact transmission means for preventing the impact transmissions means from being removed from the aperture.

10. The tool of claim 9 further comprising a spring on the impact transmission means urging the impact transmission means upward to project out of the aperture in the cap member.

11. The tool of claim 1 further comprising the provision of the impact transmission means having a length slightly greater than the distance from the top of the cap member to the bottom of the base.

12. The tool of claim 1 wherein the guide means is removable mounted in the base member.

13. The tool of claim 1 further comprising a starting section extending laterally from the base member and having a bottom surface co-planar with the bottom of the base member, the starting section having at least one starting opening through it for receiving a nail, removing means in the starting section adjacent the starting opening for removing the starting section off the nail.

14. The tool of claim 13 wherein the removing means comprises a slot having a width narrower than the diameter of the diameter of the starting opening extending from the starting opening to a secondary opening larger than the diameter of the nail.

15. The tool of claim 13 wherein the removing means comprising a slot having a width narrower than the diameter of the diameter of the starting opening extending from the starting opening to the periphery of the starting section.

16. The tool of claim 12, at least one starting opening extending from the top surface of the starting section at an angle to the workpiece out the side of the starting section.

17. The tool of claim 12 wherein the starting section is intergally formed as a part of the base member.

18. The tool of claim 12 wherein the starting section is shorter than the height of the base member.

* * * * *